US005884337A

United States Patent [19]

Dudley, Jr.

[11] Patent Number: 5,884,337

[45] Date of Patent: Mar. 23, 1999

[54] INTEGRAL HAT MIRROR

[76] Inventor: Gerald G. Dudley, Jr., 8111 Independence Apt. 8, Sterling Heights, Mich. 48313

[21] Appl. No.: 81,625

[22] Filed: May 19, 1998

[51] Int. Cl.[6] ..... A42B 1/24

[52] U.S. Cl. ..... 2/209.14; 2/209.13; 2/244; 40/329; 40/586

[58] Field of Search ..... 2/209.13, 209.14, 2/244, DIG. 8, 245, 246; 40/329, 586, 600

[56] References Cited

U.S. PATENT DOCUMENTS

| | | | |
|---|---|---|---|
| 201,016 | 3/1878 | Hoyt . | |
| 279,830 | 6/1883 | Simis . | |
| 282,443 | 7/1883 | Couch . | |
| 321,431 | 7/1885 | Gibson . | |
| 341,184 | 5/1886 | Thiers . | |
| 342,291 | 5/1886 | Ernest . | |
| 387,191 | 12/1888 | Berke | D2/891 |
| 391,040 | 2/1888 | Berke | D2/891 |
| 542,405 | 7/1895 | Best et al. . | |
| 582,724 | 5/1897 | Dromgoole et al. . | |
| 656,706 | 8/1900 | Weisenburger . | |
| 708,913 | 9/1902 | Olson . | |
| 714,731 | 12/1902 | Myers . | |
| 736,418 | 8/1903 | Merrick . | |
| 738,936 | 9/1903 | Potter et al. . | |
| 831,710 | 9/1906 | Day . | |
| 943,005 | 12/1909 | Cruver . | |
| 1,104,608 | 7/1914 | Bett . | |
| 1,124,042 | 1/1915 | Levine . | |
| 1,171,155 | 2/1916 | Tannenbaum et al. . | |
| 1,358,551 | 11/1920 | Hosford . | |
| 1,362,537 | 12/1920 | Letizia . | |
| 1,398,273 | 11/1921 | Peszternak . | |
| 1,610,241 | 12/1926 | Billings . | |

*Primary Examiner*—Diana L. Biefeld
*Attorney, Agent, or Firm*—Howard & Howard

[57] ABSTRACT

The present invention relates to a flexible mirror that can be attached to a variety of items of apparel. The flexible mirror preferably includes a low strength magnet and a hinge member, which pivotally secures the flexible mirror to a flexible surface of a item of apparel. Preferably a second low strength magnet is located on the flexible surface and engages the low strength magnet on the flexible mirror when the flexible mirror is pivoted against the item of apparel. Bending the flexible surface of the item of apparel disengages the low strength magnets from each other and permits the flexible mirror to pivot away from the item of apparel revealing the flexible mirror.

17 Claims, 2 Drawing Sheets

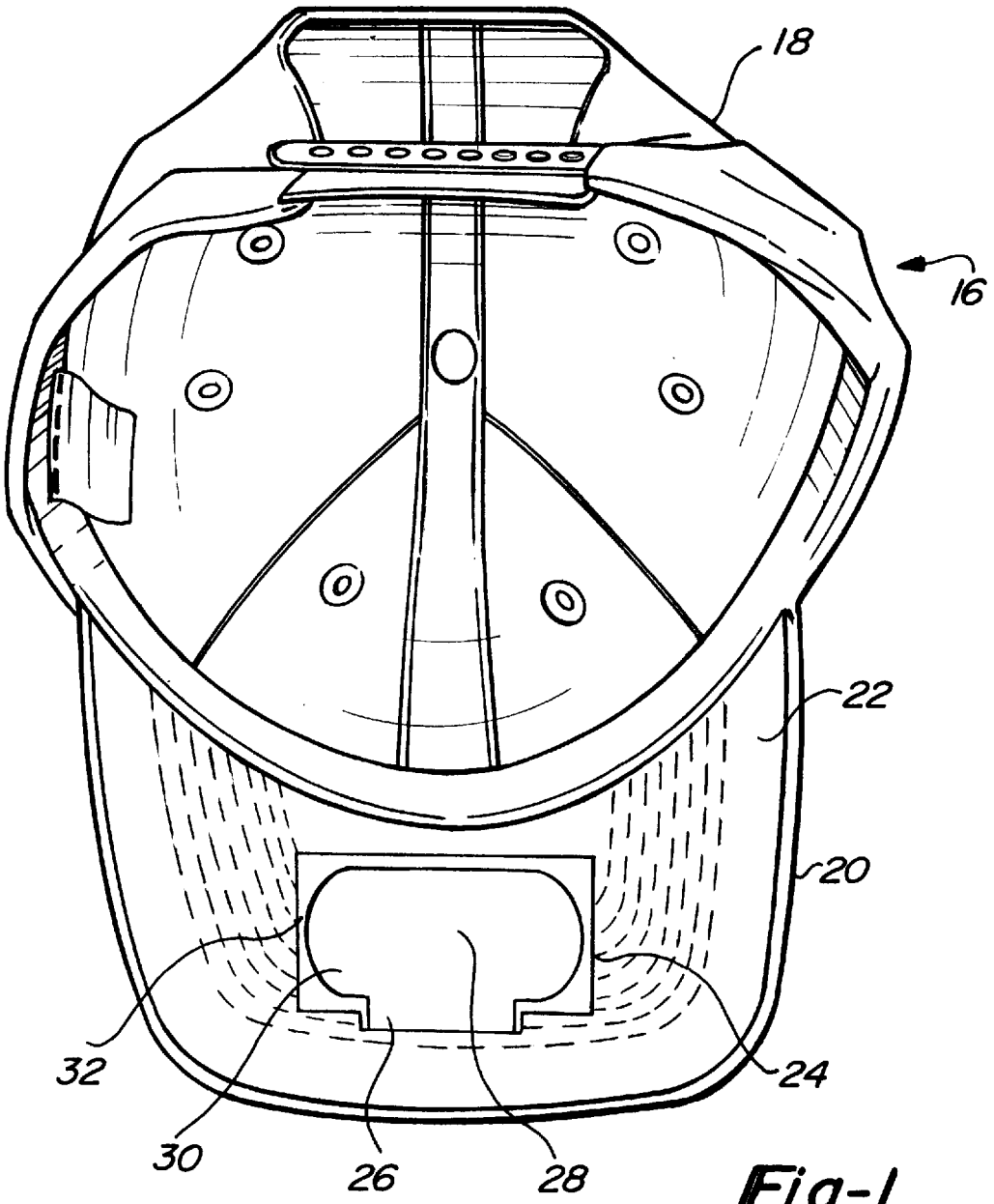
Fig-1
Fig-2
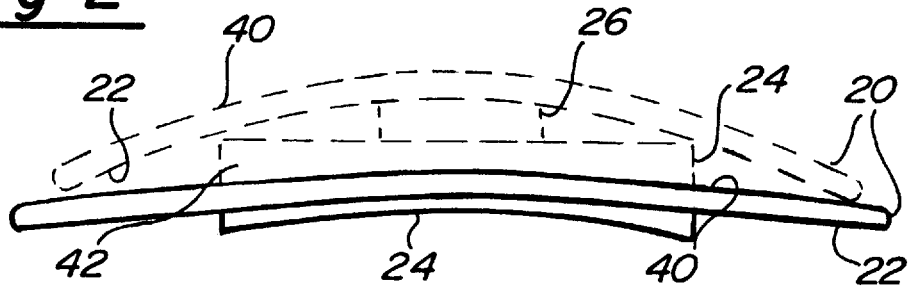

INTEGRAL HAT MIRROR

BACKGROUND OF THE INVENTION

This invention relates generally to an article of apparel and, more particularly, to a hat having a mirror mounted to it.

During the turn of the century, the wearing of hats was very prevalent. These hats generally had tall crowns. It was recognized that a hat with a tall crown provided a convenient place for securing a mirror and other vanity items such as combs. Thus, various mirrors were designed to be mounted within the crown of a hat.

One disadvantage of these prior designs is that all of the designs required that the hat wearer remove the hat in order to use the mirror. In addition, these prior designs required that the user either positioned the hat in one hand or in some fashion brace the hat before the mirror could be viewed.

Today, hat wearing is again common and one of the most frequently worn styles of hat is the "baseball cap" style. These hats, in contrast to the hats common at the turn of the century, have a very low crown and thus they cannot accommodate the mounted mirrors of past designs. Thus, it is desirable to provide a mirror that can be mounted to a baseball cap style of hat. It is also desirable to provide a mirror that can be mounted to a variety of styles of hats and that can be accessed and viewed without removing the hat or requiring a user to secure the hat. It is furthermore desirable, to design a mirror that can be mounted to other items of apparel and that provides a surface for displaying a logo or symbol that is visible to non-wearers and does not interfere with the function of the mirror.

SUMMARY OF THE INVENTION

In general terms, this invention provides a means for pivotally mounting a flexible mirror to a flexible surface of an item of apparel whereby the flexible mirror can be released from the item of apparel by bending the flexible surface of the item of apparel.

In one embodiment of the present invention, a flexible member includes a first side that is pivotally secured by a hinge member to a flexible surface of an article of apparel. The flexible surface of the article of apparel includes a first attachment structure which engages a second attachment structure located on a second side of the flexible member. The second attachment structure is releasable from the first attachment structure when the flexible surface of the item of apparel is bent. The second side of the flexible member also includes a reflective surface.

According to a second embodiment of the present invention, a flexible reflective surface is pivotally mounted by a hinge member to an underside of a brim of a hat. The flexible reflective surface is retractable against the underside of the brim. The flexible reflective surface is releasable from the underside of the brim when the brim is bent.

According to a third embodiment of the present invention, a hat comprises a brim having a first attachment structure and a flexible member having at least one symbol, a first side pivotally secured to the brim and a second side having a second attachment structure, which engages the first attachment structure. The second attachment structure is releasable from the first attachment structure when the brim is bent and the flexible member pivots downwardly to display the symbol when the second attachment structure is released from the first attachment structure.

These and other features and advantages of this invention will become more apparent to those skilled in the art from the following detailed description of the presently preferred embodiment. The drawings that accompany the detailed description can be described as follows.

BRIEF DESCRIPTION OF THE DRAWINGS

FIG. 1 is a bottom plan view of a hat having a flexible member designed according to the present invention with the flexible member in the retracted position;

FIG. 2 is a view from a wearer's perspective of a brim of the hat shown in FIG. 1 showing the brim unbent and, in phantom, the brim bent;

DETAILED DESCRIPTION OF THE PREFERRED EMBODIMENT

Figure 3:
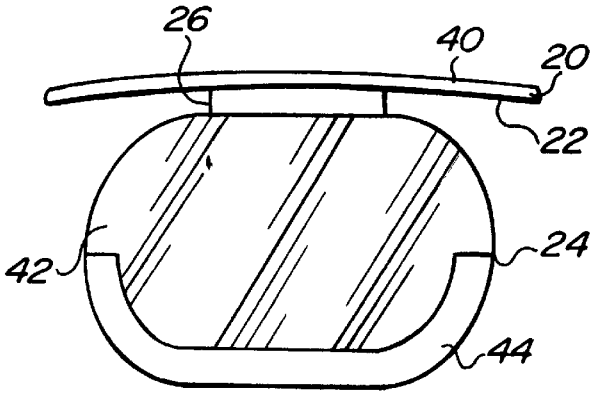
FIG. 3 is a view after the brim has been bent.

A hat is generally shown at 16 in FIG. 1. Hat 16 comprises a crown 18 and a flexible surface or brim 20 having an underside 22. A flexible member 24 is secured by a hinge member 26 to underside 22 of brim 20. A piece of material 30 is secured to a first side 32 of flexible member 24 and includes hinge member 26. A symbol 28 may be located on piece of material 30.

In FIG. 2, brim 20 is shown in the unbent position with flexible member 24 secured to underside 22 of brim 20 in a retracted position. Underside 22 is opposite an upper side 40 of brim 20. When brim 20 is bent a pre-determined amount, as shown in phantom, flexible member 24 is released from underside 22 of brim 20. Thus, a second side 42 of flexible member 24 is exposed and visible to a wearer (not shown) of hat 16.

In FIG. 3, flexible member 24 is shown in the released position as flexible member 24 would be seen by a wearer (not shown) of hat 16. A second attachment structure 44 is located on second side 42 of flexible member 24. Hinge member 26 permits flexible member 24 to pivot freely away from brim 20 when flexible member 24 is in the released position.

Figure 4:
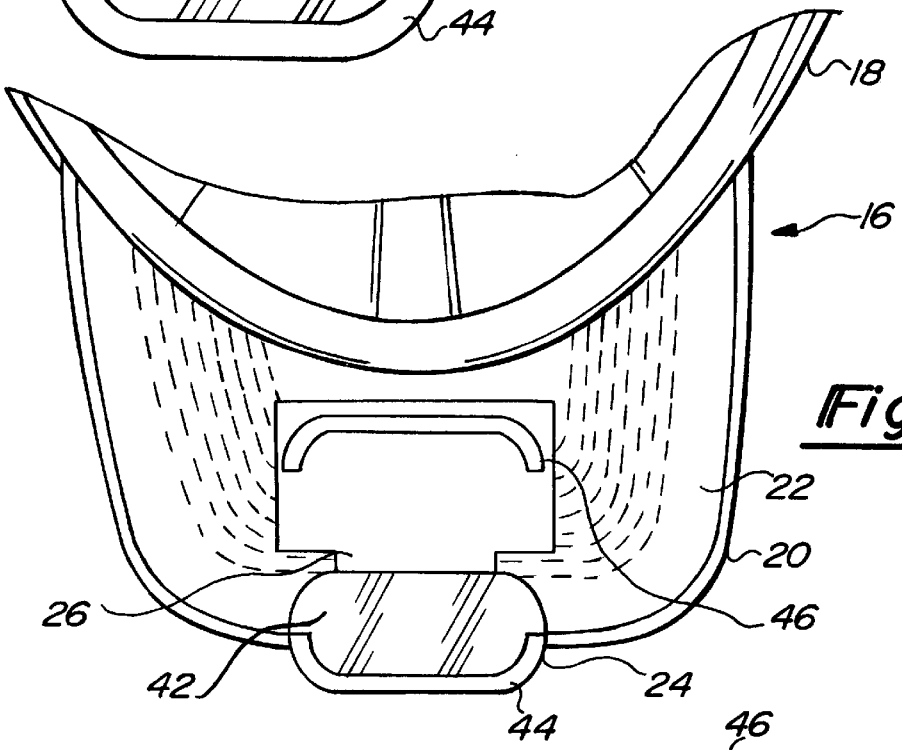
FIG. 4 is a bottom plan view of FIG. 1 with the flexible member in the released position.

FIG. 4 is a bottom plan view of hat 16 as shown in FIG. 1 with flexible member 24 in the released position. A first attachment structure 46 is located on underside 22 of brim 20. First attachment structure 46 and second attachment structure 44 are in opposed alignment when flexible member 24 is pivoted to the retracted position against underside 22 of brim 20. Engagement of first attachment structure 46 with second attachment structure 44 holds flexible member 24 in the retracted position against underside 22. As will be understood by one of ordinary skill in the art, first attachment structure 46 could be directly attached to underside 22. In such an embodiment, piece of material 30 would only secure flexible structure 24 to hinge member 26 and hinge member 26 would secure flexible member 24 to underside 22.

Figure 5:
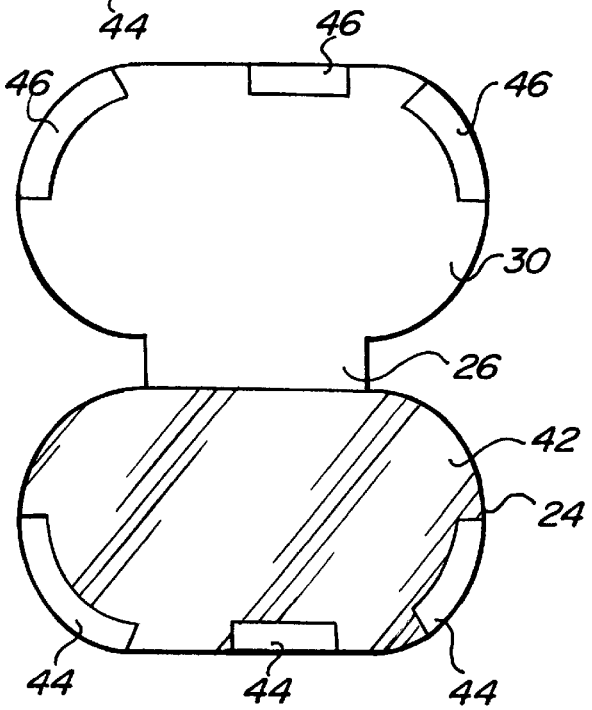
FIG. 5 is a top plan view of a mirror designed according to the present invention shown in the released position.

In FIG. 5, flexible member 24 is shown unattached to an item of apparel. In this embodiment, first attachment structure 46 is secured to piece of material 30. Hinge member 26 is located between two oval-shaped portions of piece of material 30. This embodiment permits flexible member 24 to be attached by piece of material 30 to a wide variety of flexible surfaces on items of apparel (not shown). In this embodiment, first attachment structure 46 and second attachment structure 44 are shown as a plurality of aligned structures.

In FIGS. 1–5, flexible member 24, first attachment structure 46 and second attachment structure 44 have been described in general terms, each is described more fully below.

Flexible member 24 may comprise a flexible plastic. Most preferably, second side 42 of flexible member 24 includes a reflective surface such as a mirror and flexible member 24 is formed of shatterproof material.

Preferably one of first attachment structure 46 or second attachment structure 44 comprises a low strength magnet and the other comprises a magnetically responsive material, for example, a piece of steel or iron. In the most preferred embodiment, both first attachment structure 46 and second attachment structure 44 each comprise a low strength magnet. Such low strength magnets are generally flexible and are known in the art. The magnetic attraction between first attachment structure 46 and second attachment structure 44 is sufficient to hold flexible member 24 in a retracted position. Because first attachment structure 46 is secured to a flexible surface of an item of apparel, when either first attachment structure 46 or second attachment structure 44 are bent beyond a pre-determined amount, this bending breaks the magnetic bond and flexible member 24 is released. While it is necessary that flexible surface 20 be able to flex, it must be stiff enough to prevent first attachment structure 46 from completely conforming to the shape of second attachment structure 44 when flexible surface 20 is bent. It is the non-conformance between first attachment structure 46 and second attachmnent structure 44 that breaks the magnetic force between them and releases flexible member 24. Such non-conformance is shown in the phantom representation of FIG. 2. In addition, as shown in FIG. 5, it is not necessary that first attachment structure 46 and second attachment structure 44 be a continuous single piece construction. An equivalent function could be achieved if first attachment structure 46 and second attachment structure 44 were comprised of a plurality of parts.

In the most preferred embodiment, flexible member 24 is secured to hat 16. As will be understood by one having ordinary skill in the art, FIG. 5 demonstrates that flexible member 24 could be provided as a unit with hinge member 26 and piece of material 30. Then, flexible member 24 could be secured to a flexible surface of an article of apparel other than hat 16. For example, flexible member 24 could be secured to a flexible surface such as a pocket of a shirt. The embodiment in FIG. 5 could also be secured through piece of material 30 to a badge or other flexible surface (not shown) prior to attachment to a piece of apparel.

As will be understood from FIG. 1, when flexible member 24 is released from underside 22, symbol 28 will be visible to non-wearer's of hat 16. Symbol 28 may comprise any of a variety of designs such as team names or logos. Symbol 28 may also be used to display an advertisement.

As will be understood by one of ordinary skill, flexible member 24 and first attachment structure 46 could also be mounted to upper side 40.

The present invention has been described in accordance with the relevant legal standards, thus the foregoing description is exemplary rather than limiting in nature. Variations and modifications to the disclosed embodiment may become apparent to those skilled in the art and do come within the scope of this invention. Accordingly, the scope of legal protection afforded this invention can only be determined by studying the following claims.

What is claimed is:

1. An article of apparel comprising:

a flexible surface having a first attachment structure;

a flexible member including a first side pivotally secured by a hinge member to said flexible surface and a second side having a reflective surface and a second attachment structure, said second attachment structure engaging said first attachment structure; and said second attachment structure being adapted to release from said first attachment structure when said flexible surface is bent and said flexible member being adapted to pivot away from said flexible surface when said second attachment structure is released.

2. An article of apparel as recited in claim 1 wherein said reflective surface comprises a mirror.

3. An article of apparel as recited in claim 1 wherein said article of apparel comprises a hat.

4. An article of apparel as recited in claim 3 wherein said flexible surface comprises a brim of said hat.

5. An article of apparel as recited in claim 4 wherein said flexible member is pivotally mounted to an underside of said brim.

6. An article of apparel as recited in claim 1 wherein one of said first attachment structure or said second attachment structure comprises a low strength magnet and the other of said first attachment structure or said second attachment structure comprises a magnetically responsive material.

7. An article of apparel as recited in claim 1 wherein said first attachment structure and said second attachment structure each comprise at least one low strength magnet.

8. An article of apparel as recited in claim 1 wherein said hinge member comprises a piece of material, said piece of material secured to said flexible member and to said flexible surface.

9. A hat having a flexible reflective surface, said hat comprising:

a brim having an underside;

a flexible reflective surface pivotally mounted by a hinge member to said underside, said reflective surface retractable against said underside; and said flexible reflective surface releasable from said underside when said brim is bent.

10. A hat as recited in claim 9 wherein said flexible reflective surface comprises a mirror.

11. A hat as recited in claim 9 wherein said hinge member comprises a piece of material, said material secured to said underside and to said flexible reflective surface.

12. A hat as recited in claim 9 further comprising at least one low strength magnet attached to one of said underside and said flexible reflective surface and a magnetically responsive material attached to the other of said underside and said flexible reflective surface; and said magnet and said magnetically responsive material holding said flexible reflective surface retracted against said underside and being adapted to release flexible reflective surface when said brim is bent.

13. A hat as recited in claim 9 further comprising at least one low strength magnet on each of said underside and said flexible reflective surface, said low strength magnets holding said flexible reflective surface retracted against said underside and being adapted to release said flexible reflective surface when said brim is bent.

14. A hat having a brim with a pivoting surface, said hat comprising:

a brim having a first attachment structure;

a flexible member having at least one symbol, a first side pivotally secured by a hinge member to said brim and a second side having a second attachment structure, said second attachment structure engaging said first attachment structure;

said second attachment structure being adapted to release from said first attachment structure when said brim is bent; and said flexible member pivoting to display said symbol when said second attachment structure is released from said first attachment structure.

15. A hat as recited in claim 14 wherein said second side of said flexible member includes a mirror.

16. A hat as recited in claim 14 wherein one of said first attachment structure and said second attachment structure comprises at least one low strength magnet and the other of said first attachment structure and said second attachment structure comprises a magnetically responsive material.

17. A hat as recited in claim 14 wherein said first attachment structure and said second attachment structure each comprise at least one low strength magnet.

* * * * *